United States Patent [19]

Gholson

[11] 4,004,804

[45] Jan. 25, 1977

[54] GAME APPARATUS

[76] Inventor: William T. Gholson, 9853 Ventura St., St. Louis, Mo. 63136

[22] Filed: Jan. 2, 1976

[21] Appl. No.: 646,021

[52] U.S. Cl. ..... 273/5 R; 273/6; 273/59 R; 273/123 R; 273/127 B; 273/22

[51] Int. Cl.[2] ..... A63D 15/00; A63D 15/04

[58] Field of Search ..... 273/3 R, 3 A, 3 B, 3 C, 273/4 R, 4 A, 4 C, 5 R, 14, 108, 118 R, 119 R, 123 R, 95 H, 118 A, 118 D, 119 A, 119 B, 123 A, 10

[56] References Cited

UNITED STATES PATENTS

| | | | |
|---|---|---|---|
| 575,097 | 1/1897 | Beman | 273/123 R |
| 602,179 | 4/1898 | Haskell | 273/123 R |
| 1,119,753 | 12/1914 | Hansen | 273/123 R |
| 1,409,527 | 3/1922 | Debelack et al. | 273/14 |
| 1,567,966 | 12/1925 | McKenzie | 273/108 X |
| 1,666,474 | 4/1928 | Sorell | 273/108 |
| 3,315,965 | 4/1967 | Wiederspan | 273/14 X |
| 3,399,890 | 9/1968 | Galedrige | 273/3 R X |
| 3,504,914 | 4/1970 | Bradbury | 273/118 R |

FOREIGN PATENTS OR APPLICATIONS

| | | | |
|---|---|---|---|
| 9,767 | 1902 | United Kingdom | 273/118 R |
| 390,481 | 6/1931 | United Kingdom | 273/2 |

*Primary Examiner*—Richard C. Pinkham
*Assistant Examiner*—Arnold W. Kramer
*Attorney, Agent, or Firm*—Emory L. Groff, Jr.

[57] ABSTRACT

A game apparatus simulating a combination of golf and pool includes a game top comprising either a self-supporting substantially planar member or one adapted to be disposed atop a conventional pool table and is played by one or more persons each utilizing a cue, cue ball and a plurality of distinctive sequentially numbered playing balls. The game top is provided with specific rack marking indicia in the center for initially spotting all of the playing balls and includes corner out-of-bounds markers and two side markers, each of the latter intended to receive only those playing balls of one of the players.

9 Claims, 5 Drawing Figures

FIG. 1.
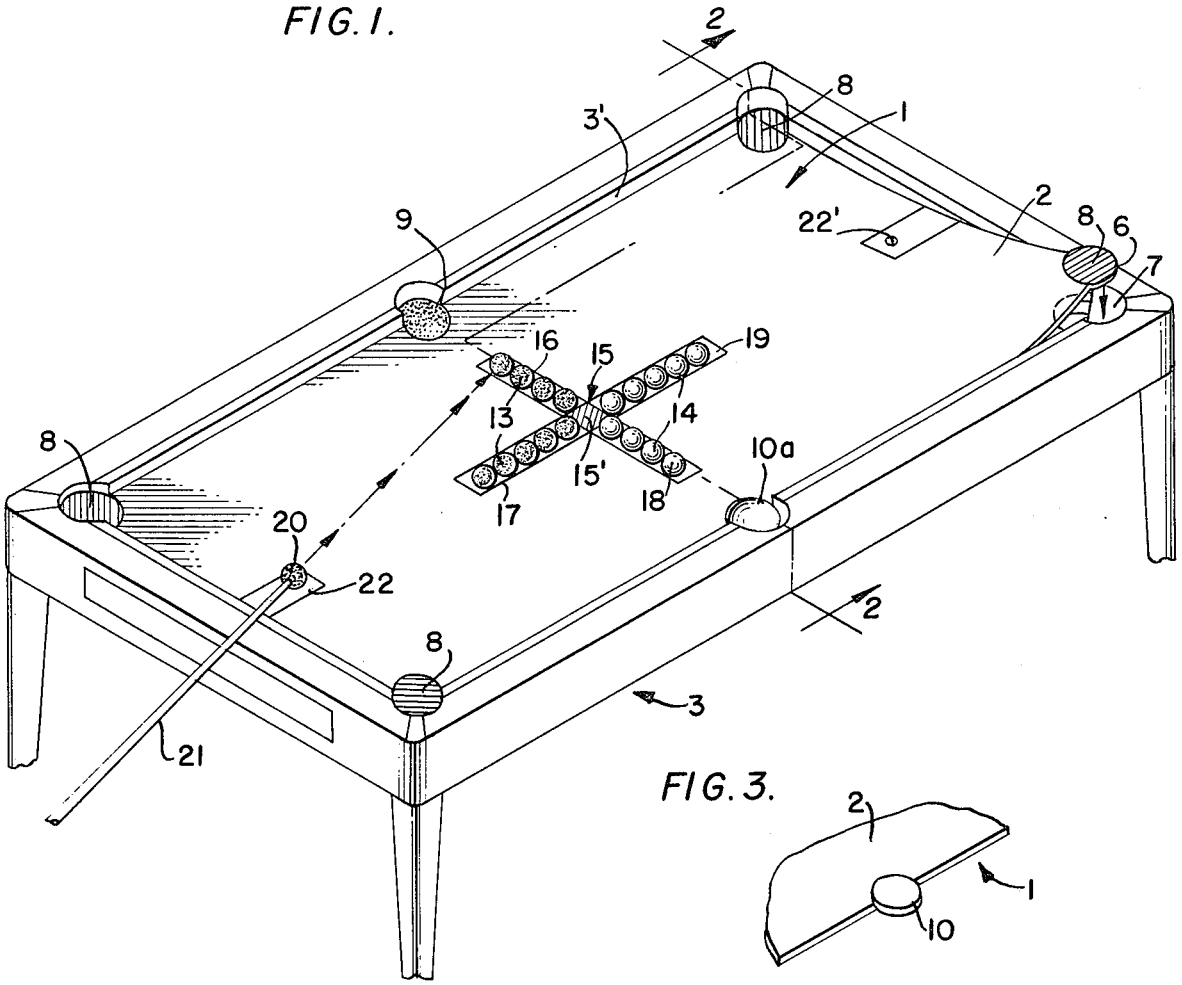
FIG. 3.
FIG. 2.
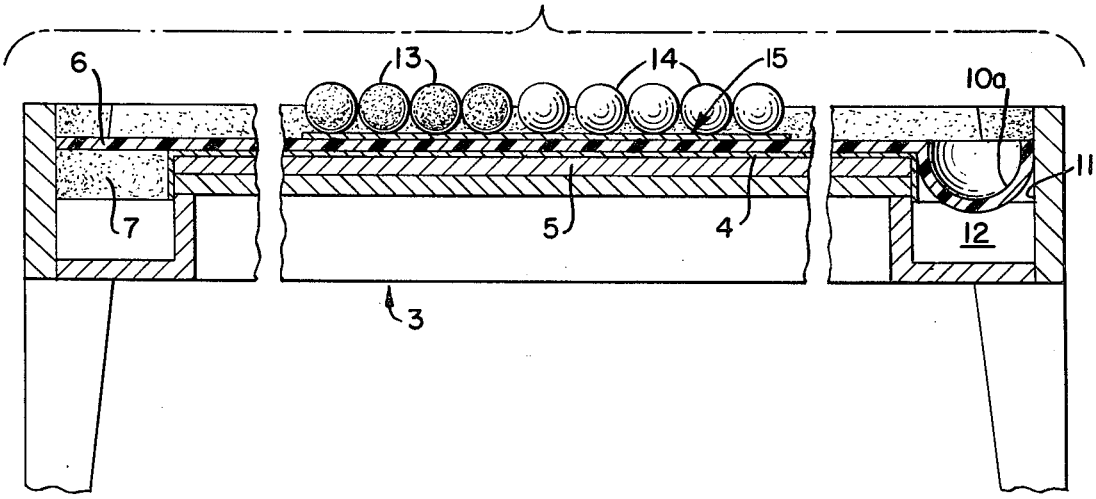

GAME APPARATUS

This invention relates generally to a game device and more particularly to an improved game apparatus adapted to be played by one or more players utilizing a cue, cue ball and a plurality of balls disposed upon a specially constructed playing surface.

The game simulates portions of both the game of golf as well as the game of billiards and in fact the unique playing surface of this game is readily adaptable for use upon a standard billiard table or, on the other hand, in combination with either an ordinary table or one specifically constructed with the subject game in mind.

With the game top of the instant invention a playing surface is provided having a plurality of corner out-of-bounds markers together with a single tee and a side ball marker or cup for each of two players. A plurality of balls, colored or otherwise designated for each of the two players, are intended to be racked up in the center of the playing surface, whereupon each player proceeds, in turn, to drive a cue ball from his respective tee to sequentially direct his respective playing balls into but one cup or marker with the winner of the game being determined by the player requiring the fewest number of strokes of the cue and cue ball in order to drive all of his playing balls into his single designated marker or cup.

When a conventional billiard table is utilized as the game support means for the game top of the present invention, corner tabs projecting from the four corners of the rectangular game top serve to completely mask or cover over the existing billiard table corner pockets and thereby designate out-of-bounds markers at the four corners of the game top, while the remaining two side pockets of the billiard table respectively serve as the markers or cups for the reception of the playing balls of the two players.

Accordingly, one of the primary objects of the present invention is to provide an improved game apparatus including a game top utilized in combination with support means and having out-of-bounds markers at the four corners thereof and with a ball receiving cup intermediately disposed along each side of the game top.

A further object of the present invention is to provide an improved game apparatus including a game top adapted to overlie the playing surface of a conventional billiard table and including tab extensions at the four corners thereof providing co-planar covers for the billiard table corner pockets and wherein the two side pockets of the billiard table are open and accessible from the game top.

Still another object of the present invention is to provide an improved game apparatus including a table support containing a primary playing surface bounded on four sides by a rail and having out-of-bounds markers at the four corners thereof with a single side pocket intermediate each side rail of the table.

Another object of the present invention is to provide an improved game apparatus played by one or more persons each having a cue, cue ball and plurality of playing balls wherein each player seeks to sequentially drive his playing balls into a single marker in the fewest possible strokes without driving any of the balls into a plurality of out-of-bounds markers.

With these and other objects in view which will more readily appear as the nature of the invention is better understood, the invention consists in the novel construction, combination and arrangement of parts hereinafter more fully described, illustrated and claimed.

A preferred and practical embodiment of the invention is shown in the accompanying drawings in which:

FIG. 1 is a top perspective view illustrating the game top of the present invention in combination with a standard billiard table;

FIG. 2 is an enlarged vertical sectional view taken along the line 2—2 of FIG. 1;

FIG. 3 is a fragmentary perspective view of an alternative side marker

Similar reference characters designate corresponding parts throughout the several figures of the drawings.

Figure 4:
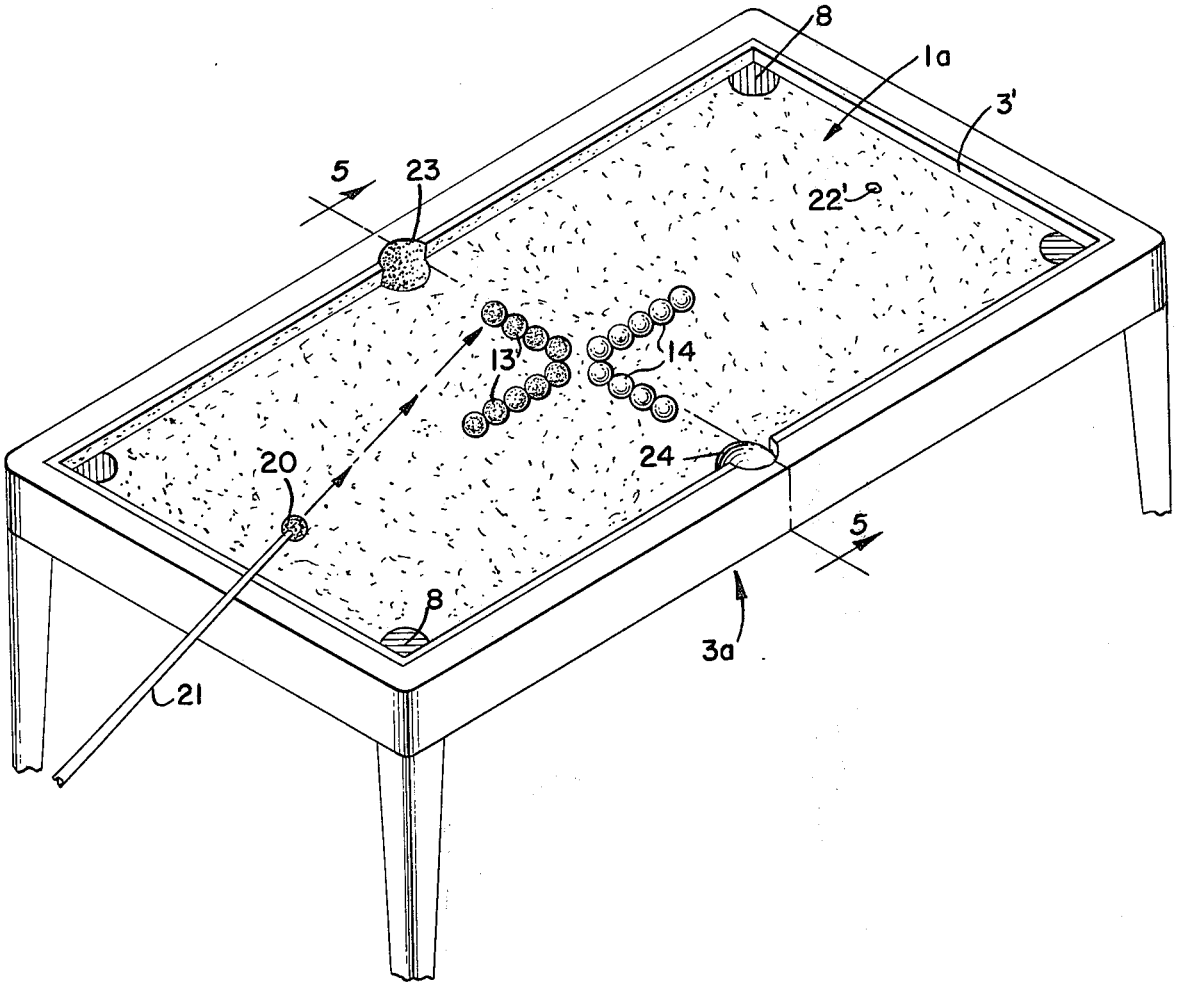
FIG. 4 is a top perspective view of a modification of the game apparatus of the present invention.
Figure 5:
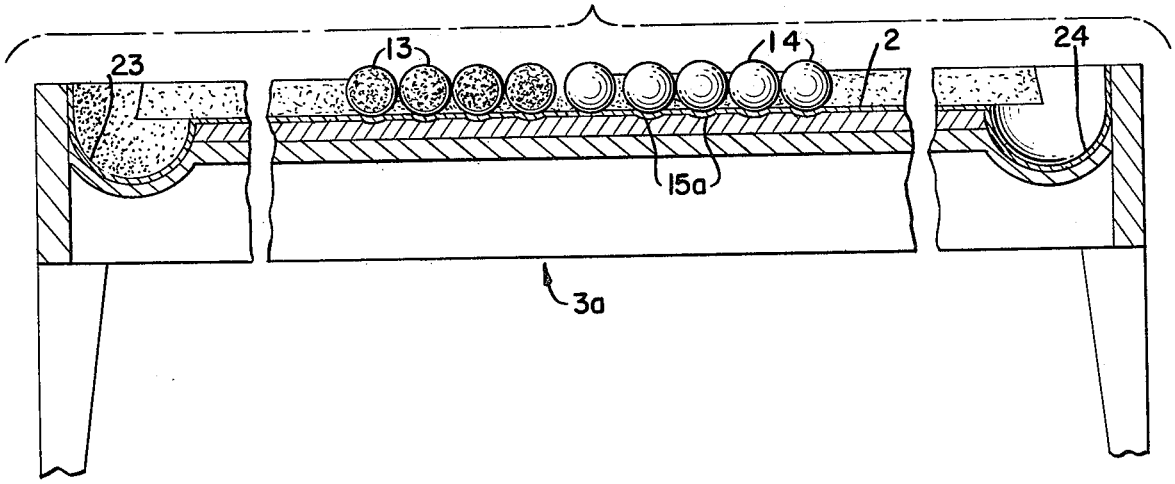
FIG. 5 is an enlarged vertical sectional view taken along the line 5—5 of FIG. 4.

Referring now to the drawings, particularly FIG. 1, the game apparatus of the present invention will be seen to include a game top generally designated 1, comprising a planar member providing a substantially rectangular uppermost playing surface 2. The instant game is most conveniently played when the game top 1 is disposed in a horizontal plane at an elevation of approximately 30 inches from the floor, and accordingly suitable support means are necessary in order to thusly position and retain the game top 1. In the embodiment illustrated in FIGS. 1–3 of the drawings the game top 1 is adapted to be supported upon the playing surface of a conventional billiard table 3. As shown in FIG. 2, the game top 1 rests directly upon the felt covering 4 of the billiard table which felt in turn is disposed upon the usual slate top 5.

Regardless of the types of underneath support employed, the construction of the game top 1 is quite critical for playing the subject game. The material of the game top may be any suitable composition which is substantially rigid such that all portions of the playing surface 2 will remain in a co-planar disposition when the game top 1 is disposed upon the felt covering 4 of the billiard table. Each of the four corners of the game top are provided with extensions or tabs 6 constructed to provide a close mating fit within the configuration of the openings leading to the corner pockets 7 of the billiard table such that the area of each of these corner pockets disposed below the plane of the game top playing surface 2 is effectively blocked out. The upper surface of each of the four corner tabs 6 is provided with a suitable distinctive indicia or colored in a manner different than the balance of the playing surface 2 so as to designate an out-of-bounds marker 8. In the area of the two side pockets of the billiard table 3 a first player marker 9 and a second player marker 10 are provided. As shown most clearly in FIG. 3, these latter markers 9 and 10 may comprise tabs or projections similar to the corner tab 6 and which are appropriately colored such as red and white, to identify a first player's marker and a second player's marker, respectively. Alternatively, the markers 9 and 10 may comprise extensions of the playing surface 2 which are formed as cups 10*a* as shown in FIG. 2 of the drawings, which cups are arranged to be disposed within the upper portion of the side pockets 11 of the billiard table. Quite obviously the markers 9 and 10 or side cups 10*a* could be omitted and the game top 1 could be cut away to expose the existing side pockets 11 of the billiard table 3, whereupon the ball returns 12 of the table would be utilized during the subsequent play of this game.

A plurality of movable playing elements are provided for each player of this game and include a plurality of first player balls 13 and second player balls 14. Prior to initiation of play of the game all of the balls 13 and 14 are racked up as shown in FIG. 1 of the drawings, wherein it will be seen that all of the first player's balls 13 are preferably of one color such as red, while all of the second player's balls 14 are of a distinguishing color, such as white. To facilitate spotting of the balls 13–14 in the manner illustrated, suitable cruciform rack marking means 15 may be printed, painted or otherwise provided on the top of the playing surface 2. The marking means 15 includes a first player side leg 16, first player end leg 17, second player side leg 18 and second player end leg 19, and prior to the start of play the balls 13–14, which are numbered from 1 through 9 for each player, are spotted with ball No. 1 at the distal portion of each side leg 16 or 18 with the numbers increasing toward the center of the rack marking means 15 and thence progressing outwardly to the distal portion of the end leg 17 or 19, such that the two balls No. 9 will be disposed at the distal portions of the end legs 17 and 19.

The objective of the game is for each player to drive all of his playing balls numbered 1 through 9 sequentially into his respective marker or cup 9 or 10 in the least number of strokes, with the player achieving this feat in the lesser number of strokes being declared the winner. The balls are driven into the respective side markers 9 or 10 by means of a cue ball 20 and cue 21. For this purpose, a first player's tee marker 22 is provided atop the playing surface 2 at one end of the game top 1 and a second player's tee marker 22′ is similarly provided adjacent the opposite end of the game top 1.

With the foregoing description of the game top construction in mind, the manner of proceeding with play of the game may now be described. With the balls racked as shown in FIG. 1 of the drawings, and the first player's cue ball 20 disposed upon his tee 22, it will be this first player's objective to hit the one of his balls 13 which is numbered 1 and which is at the distal portion of the side leg 16, so as to drive this ball 13 into the first player's marker or cup 9 as shown by the arrows in FIG. 1 of the drawings. The first player continues to move his ball numbered 1 by means of his cue 21 and cue ball 20 until the ball 13 numbered 1 is driven into the side marker or cup 9, keeping track of the number of strokes required to accomplish the same. After the first player's No. 1 ball has been driven into his respective marker 9, the second player follows by placing the cue ball 20 upon the second player's tee 22′ and using his cue 21 drives his No. 1 ball 14 into the second player's marker or cup 10. Thereafter, play returns to the first player and he proceeds as before, to drive his No. 2 ball in the same manner into his marker or cup 9 and play continues thusly between the two players until all nine balls 13 of the first player have been driven into the marker 9 and all nine balls 14 of the second player have been driven into the marker 10, whereupon the total strokes used by both players is calculated to determine the winner, which is the player having used the fewest strokes to hole out all of his balls 13 or 14.

If during the play of the game either player knocks any ball off the game top 1, into any of the out-of-bounds markers 8, one of his balls into the other player's side marker or a wrong numbered ball of his own into his own marker, then this ball is returned to the center area 15′ of the rack marking means 15 and that player is then assessed a penalty stroke, with the cue ball 20 being returned to that player's tee before proceeding with the play. As illustrated in FIGS. 3 and 4 of the drawings, the game top 1*a* of the present invention is shown as comprising an integral part of its own support means or table 3*a*. The game is played in exactly the same manner as described above in connection with the embodiment of FIGS. 1–3 and again as in the earlier form the side markers 23 and 24 may comprise actual cups as shown in FIG. 4 or merely distinguishing indicia painted or printed on the upper portion of the playing surface 2 as in FIG. 3, it being quite obvious that when the side markers merely comprise a co-planar area as in FIG. 3 the play of the game becomes far more delicate during the final stroke of each ball. The rack marking means may comprise the indicia 15 as shown in FIG. 1 or alternatively, a plurality of minute depressions 15*a* may be formed in the playing surface 2 to serve as spotting means for each of the nine balls 13 and nine balls 14.

From the above it will be seen that a game apparatus is provided comprising a unique game top which may be offered in a form readily adaptable for use in combination with a conventional billiard table or which may alternatively be constructed with its own supporting table and additionally it would be quite obvious to also provide merely the game top 1 of the present invention together with its own integral peripheral rail such as the rail 3′ of the tables 3 and 3*a*, whereupon the game top could be merely disposed upon any readily available table such as a dining room table.

I claim:

1. A game apparatus including, a rectangular game top having a substantially planar upper playing surface, means supporting said game top at a fixed elevation, out-of-bounds markers at the four corners of said playing surface, a tee marker of a first color adjacent one end of said playing surface, a cue ball of said first color adapted to be spotted on said tee marker upon the initiation of play, a tee marker of a second color adjacent the opposite end of said playing surface, a cue ball of said second color adapted to be spotted on said second color tee marker, a plurality of sequentially numbered playing balls of said first color and a plurality of sequentially numbered balls of said second color disposed upon said playing surface, rack marking means in the center of said playing surface for initially spotting all of said playing balls, a side marker of said first color intermediately disposed along one side of said playing surface, a side marker of said second color intermediately disposed along the opposite side of said playing surface, and cues adapted to be used by two players each to drive one of said colored cue balls to sequentially strike said numbered playing balls of a similar color into one said side marker of a similar color.

2. A game apparatus according to claim 1 wherein, said supporting means comprises a billiard table having a playing surface and corner and side pockets, said game top completely overlying said billiard table playing surface with said out-of-bounds markers disposed at said corner pockets and said side markers disposed at said side pockets.

3. A game apparatus according to claim 2 wherein, said out-of-bounds markers comprise tabs extending from the corners of said rectangular game top to mask out the top of said corner pockets, and distinguishing indicia on said tabs.

4. A game apparatus according to claim 2 wherein, said side markers comprise said side pockets.

5. A game apparatus according to claim 2 wherein, said side markers comprise tabs extending from the sides of said game top to mask out the top of said side pockets.

6. A game apparatus according to Claim 1 wherein, said rack marking means includes a cruciform indicia having two end legs aligned with said tee markers and two side legs aligned with said side markers.

7. A game apparatus according to claim 6 wherein, one said end leg and side leg opposite said tee marker and side marker of said first color are likewise of said first color and said remaining end leg and side leg are of said second color.

8. A game apparatus according to claim 1 wherein, said side markers comprise cups.

9. A game apparatus according to claim 1 wherein, said rack marking means includes a plurality of depressions in said playing surface disposed in a cruciform manner.

* * * * *